United States Patent [19]

Kanazawa

[11] 4,284,022

[45] Aug. 18, 1981

[54] BENDING APPARATUS

[76] Inventor: Yukio Kanazawa, 880, Sekishi-cho, Hamamatsu-shi, Shizuoka-ken, Japan

[21] Appl. No.: 39,160

[22] Filed: May 15, 1979

[51] Int. Cl.[3] ..... B21D 19/00

[52] U.S. Cl. ..... 113/58

[58] Field of Search ..... 113/54, 57, 58; 72/210, 72/211; 29/243.5, 243.52

[56] References Cited

U.S. PATENT DOCUMENTS

| | | | |
|---|---|---|---|
| 3,195,492 | 7/1965 | Erickson | 113/54 |
| 3,435,791 | 4/1969 | Wieters | 113/58 |
| 3,875,642 | 4/1975 | Knudson | 113/58 |

FOREIGN PATENT DOCUMENTS 54-3665 2/1979 Japan .

*Primary Examiner*—Neil Abrams
*Attorney, Agent, or Firm*—Armstrong, Nikaido, Marmelstein & Kubovcik

[57] ABSTRACT

An apparatus used for forming lips by outwardly bending the end of a metal plate which may be joined with the bent end of another plate so as to form a duct used for an air-conditioning ventilation system. The end to be bent is reinforced with a continuous guide member connected thereto, said guide member being generally L-shaped in cross-section, leaving a given width to form a lip. The bending apparatus is comprised of a roller for engaging and rotating along the guide plate which serves as a supporting member and a guide rail. The apparatus is further comprised of a pressing disc for contacting under pressure the end to be bent. The disc acts in cooperation with the engaging roller at a position opposite thereto. Accordingly, the end is bent as the disc and roller are rotated. The bending apparatus is designed to move along said reinforced guide, bending the end of a metal plate so as to continuously form a lip which is L-shaped in cross-section. The space between the pressing roller and the engaging roller can be adjusted relative to the thickness of a metal plate to be bent by an adjustment means. Said adjustment means positions the whole apparatus in place on a metal sheet. In addition, the pressing disc includes a shaping roller which contacts a portion of the end to be bent, said shaping roller making the bending portion easier to carry out. A power source is placed on the bending apparatus, the power source being counterbalanced in order to eliminate any biasing force on the shaping portions of said engaging roller and said pressing disc during operation.

15 Claims, 27 Drawing Figures

FIG. 9
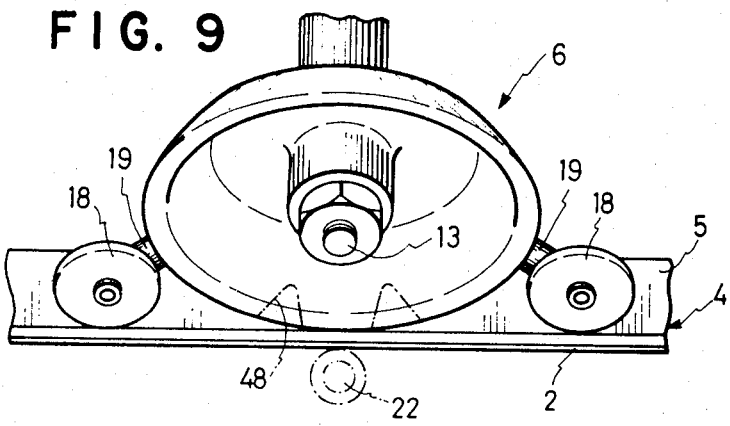
FIG. 10
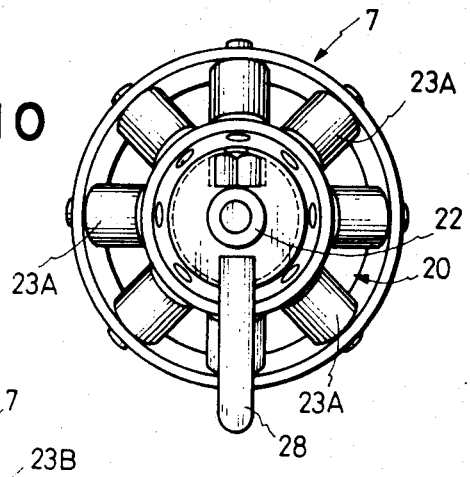
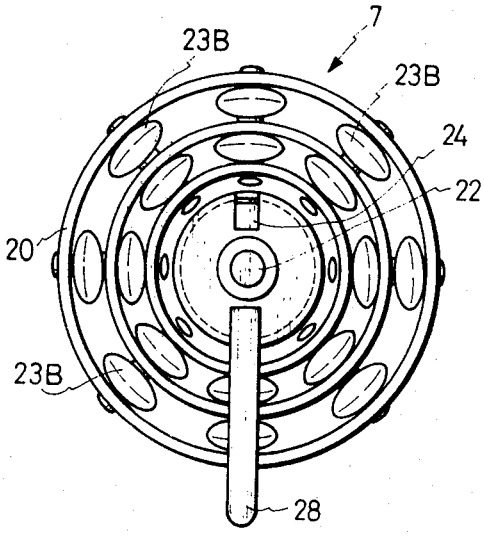
FIG. 11

BENDING APPARATUS

BACKGROUND OF THE INVENTION

1. Field of the Invention

The present invention relates to an apparatus for forming a lip portion by outwardly bending the end portion or edge of a metal plate or the like to be used as an air-conditioning duct.

2. Description of the Prior Art

Heretofore, a hammer or the like has been utilized for forming a lip portion from the end portion of a joint portion of an air conditioning duct or the like. However, the forging operation of a hammer is low in efficiency and accuracy, and a uniformly bend condition cannot be obtained. In addition, the forging operation is accompanied by a most undesirable noise caused by the beating.

In order to solve the above-described problems, there is proposed herein a bending apparatus which moves along the end portion of a metal plate while automatically bending the plate. The apparatus of this invention provides high efficiency, accuracy and simplicity in handling during operation.

SUMMARY OF THE INVENTION

The principal object of the present invention is to provide a bending apparatus with high efficiency and accuracy in operation, and which is easy to handle.

It is another object of the present invention to provide a bending apparatus which has an engaging roller trapezium shaped in cross-section, thereby protecting the rotation of the engaging roller from the fixed part of a guide member and other interruptive materials.

It is still a further object of the present invention to provide a bending apparatus which has an engaging roller formed with U-shaped cavities or retractable projections on the circumferential surface thereof, thereby enabling easy turning of the apparatus at the corner of a duct or the like, where said cavities engage with the corner to push the apparatus forward.

It is a still further object of the present invention to provide a bending apparatus which has a pair of auxiliary rollers on both sides of an engaging roller, thereby providing stable movement and no inclination during vertical movement of the apparatus.

Another object of the present invention is to provide a bending apparatus including a pressing disc, a disc portion and a roller contacting a material, which is arranged in a T-shape, so as to securely hold the bending apparatus in place and enable the smooth movement and easy bending operation, in cooperation with the engaging roller.

A still further object of the present invention is to provide a bending apparatus including a disc portion which has a pressing surface raised toward its center which allows the end of the plate which is to be bent to be easily introduced to the process by which it will be bent.

It is a still further object of the present invention to provide a bending apparatus having a pressing surface comprised of a disc portion formed with various patterns of convexity and concavity, so as to easily introduce the end portion which is to be bent.

It is still another object of the present invention to provide a bending apparatus which has a roller for contacting a material to be bent, said roller being formed with a plurality of indentations on the circumferential surface thereof so as to increase the frictional resistance between said roller and the material and to securely transmit the rotational force from the power source, thereby resulting in positive movement of the apparatus.

It is another object of the present invention to provide a bending apparatus which includes a means for adjusting a space between a pressing disc and an engaging roller, said space adjusting means serving also as a means for engaging with a material to be bent.

A still further object of the present invention is to provide a bending apparatus including a standardized space-adjusting means for setting the space between a pressing disc and an engaging roller for use on a standardized thickness of metal material which is to be bent, in addition to the aforementioned space-adjusting means.

It is a still further object of the present invention to provide a bending apparatus which includes an automatic stopping means, whereby said bending means automatically stops upon meeting an interruptive piece on the metal which is being bent.

It is a further object of the present invention to provide a bending apparatus which includes an automatic stopping means which stops when the bending operation is complete.

A still further object of the present invention is to provide a bending apparatus which includes a drive motor in a position suitable to counter-balance the bending apparatus in order to place equal weight on the bending portions of the pressing disc and engaging roller.

It is a still further object of the present invention to provide a bending apparatus which includes a transmitting mechanism for easy transmission of the rotation of the drive motor to the engaging roller and the pressing disc.

These and other objects and advantages of the present invention will become apparent to those persons skilled in the art upon reading the details of construction and usage as are more fully set forth below. Reference is made to the accompanying drawings forming a part hereof, in which like numerals designate like parts throughout.

BRIEF DESCRIPTION OF THE DRAWINGS

FIG. 9 is a partially enlarged view showing a roller contacting with a metal plate to be bent;

FIG. 10–FIG. 19 are partially enlarged views and cross-sectional views showing various embodiments of a pressing disc;

FIG. 21 is a partially enlarged view of a portion of FIG. 20;

FIGS. 22 and 23 are partially enlarged cross-sectional views showing embodiments of shaping rollers.

DETAILED DESCRIPTION OF THE PREFERRED EMBODIMENTS

Figure 1:
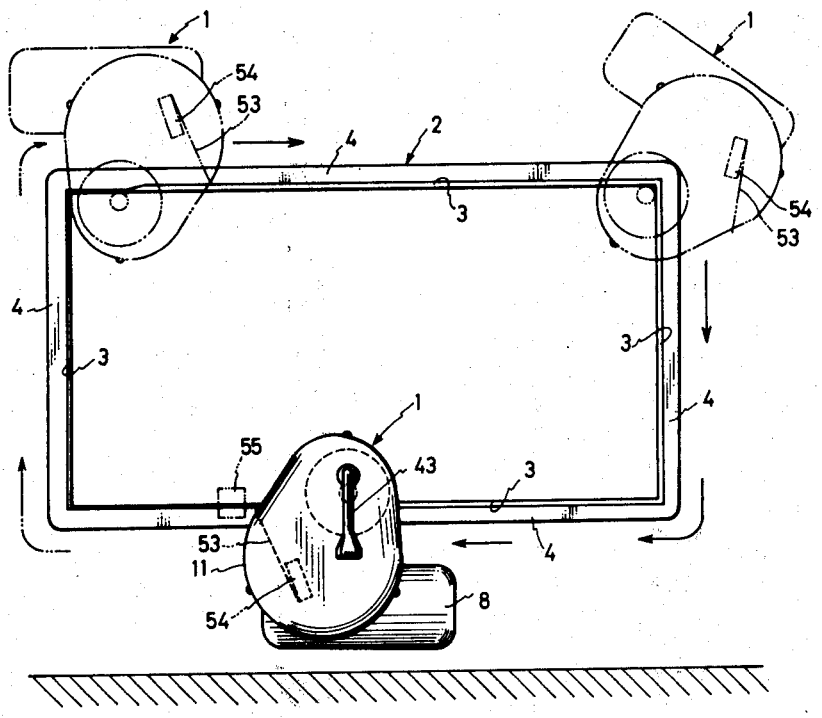
FIG. 1 is a front plan view of the device in operation.
Figures 2A, 2B:
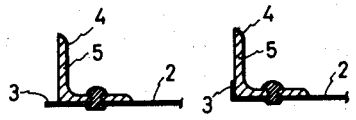
FIG. 2A is a cross-sectional view of an end of a duct before bending.
FIG. 2B is a cross-sectional view of a duct after bending.
Figure 3:
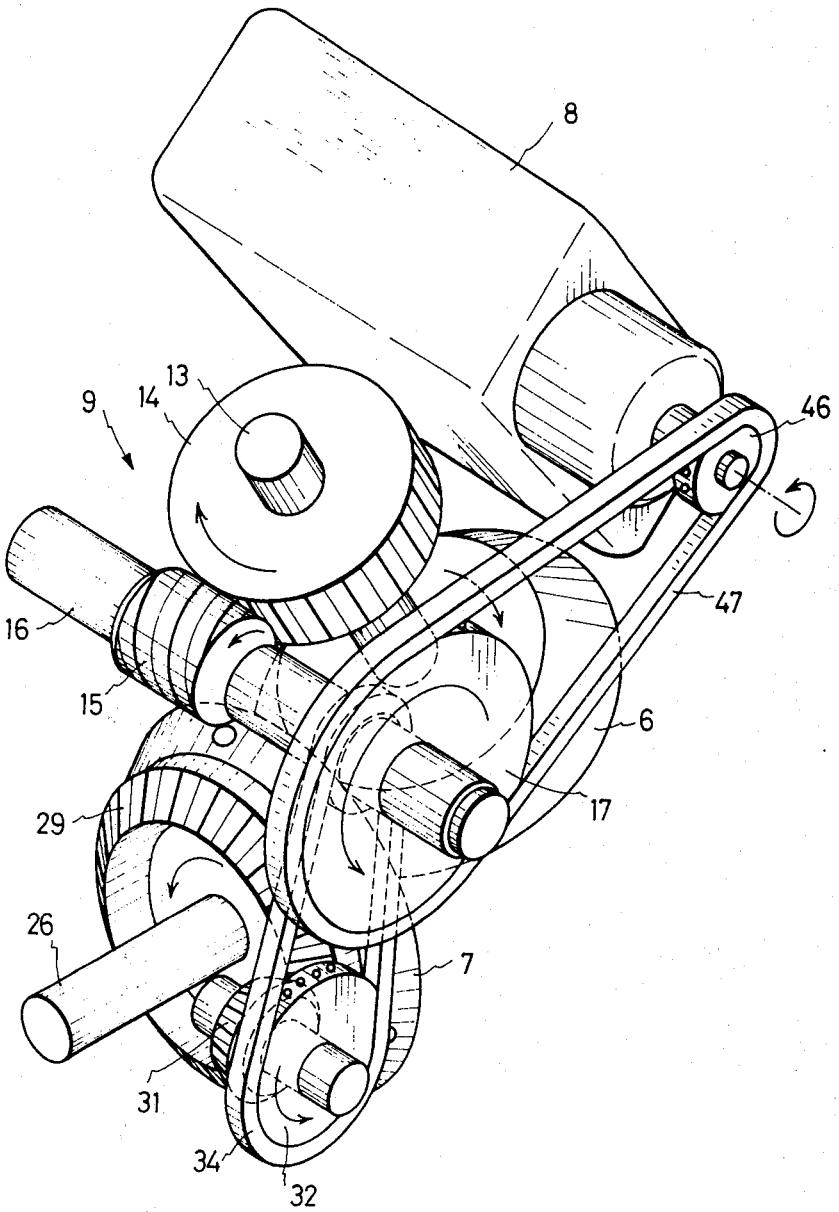
FIG. 3 is a perspective view showing the bending apparatus.
Figure 4:
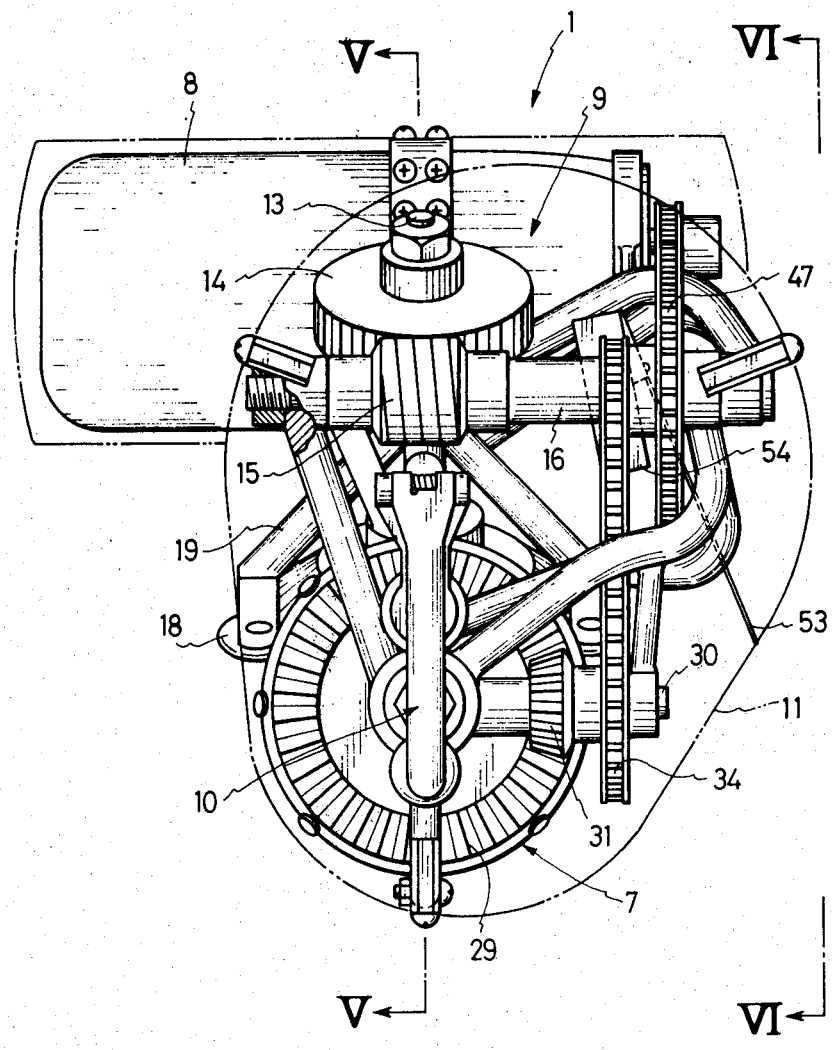
FIG. 4 is a front view of FIG. 3.

Referring now to the drawings, and to FIG. 1 in particular, which shows the bending apparatus of the present invention as it moves along the end portion 3 (shown in FIG. 2A) of a duct 2 in order to bend end portion 3 outwardly (shown in FIG. 2B).

The portion 3 to be bent is the end of a metal plate reinforced with a guide member 4 which is L-shaped in cross-section. A portion of guide 4 runs parallel to the end portion, leaving a width to be bent. Said guide is secured by rivets or the like. The guide member serves as a support as well as a guide rail for the apparatus.

The bending apparatus 1 of the present invention includes an engaging roller 6 rotatably adjoining with the inner side surface of an upright portion 5 of the reinforced guide member 4. The device 1 is further comprised of a pressing disc 7 having a generally T-shaped cross-section corresponding to the outer configuration of the angular portion of the guide member 4. The disc 7 cooperates with said engaging roller 6 to press and bend the end portion 3 while being rotated by a drive motor 8 which may be an electric or hydraulic motor. In order to drive the engaging roller 6, and pressing disc 7, there is provided an interconnecting transmission mechanism 9. The mechanism 9 converts the rotation of the drive motor 8 into a suitable rotational speed for rotating the engaging roller 6 in synchronism with the pressing disc 7. The device includes an adjustment means 10 for adjusting the space between the engaging roller 6 and the pressing disc 7, said adjustment means 10 being constructed so as to mount the whole apparatus in place. A cover 11 covers the movable elements.

Figure 5A:
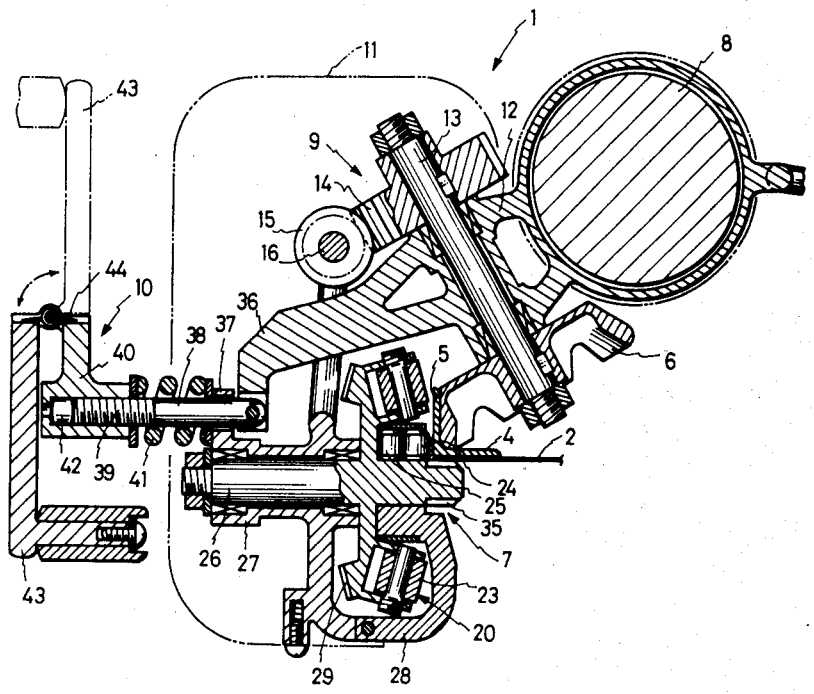
FIG. 5A is a cross-sectional view taken along the line V—V of FIG. 4.
Figure 6:
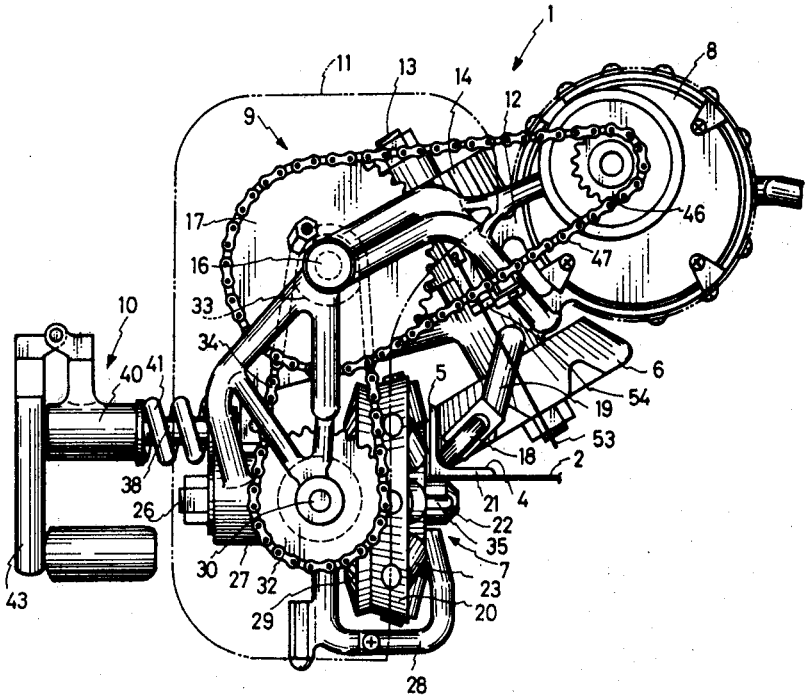
FIG. 6 is a view seen from the arrow line VI—VI of FIG. 4.

Referring now to FIG. 5A, the engaging roller 6 is fixed to the forward end of shaft 13 and is inserted into a supporting frame 12 having a generally dish-shaped or trapezium-shaped cross-section. A transmitting mechanism 9 has a gear 14 attached to the rear end of the shaft 13. The gear 14 engages worm 15. A shaft 16 of the worm 15 is provided with a sprocket wheel 17 as seen in FIG. 6. The sprocket wheel 17 is engaged with a sprocket wheel 46 of drive motor 8 via chain 47. The motor 8 is connected to supporting frame 12. The rotation of the drive motor 8 is transmitted to the engaging roller 6. The location of the drive motor 8 on the supporting frame 12 is determined by considering the weight balance of the bending apparatus 1 in which the engaging roller 6 and the pressing disc 7 cooperate to press the metal plate positively and uniformly. On both sides of the engaging roller 6, on supporting frame 12, is provided a pair of contacting rollers 18. The rollers 18 contact the inner side surface of the upright portion 5 of the reinforcing guide member 4. The rollers 18 are rotatably fixed on the supporting frame 12 by the supporting frame 19 (shown in FIG. 9). The contacting rollers 18 provide a suitable stance for the engaging roller 6 extending on both sides thereof. The rollers 18 contact the upright portion 5, and thereby actuate positive movement of the apparatus 1. The bending apparatus 1 is effectively supported by the rollers 18, particularly when apparatus 1 is inclined and moving upward along the vertical end of the duct 2.

Figure 5B:
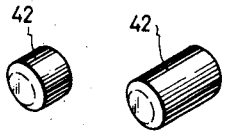
FIG. 5B is a perspective view showing an example of a spacer means.
Figure 19:
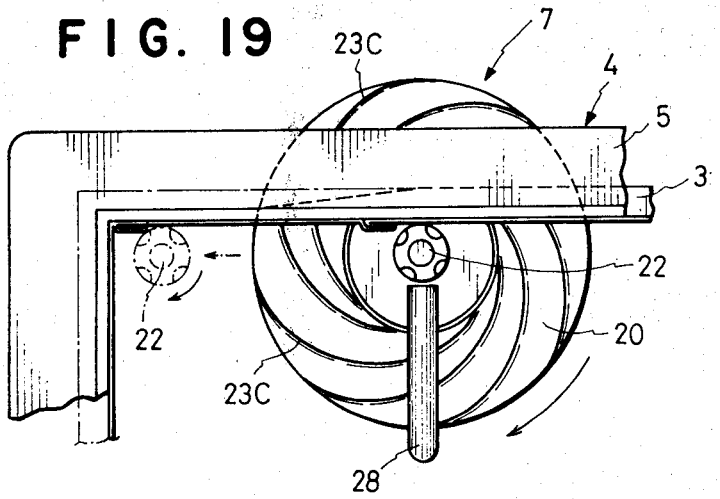

The pressing disc 7 consists of a disc portion 20 which faces the outer side surface of the upright portion 5 of the guide member 4. Disc 7 is further comprised of contacting roller portion 22 which faces the outer side surface of the fixed portion 21 of the guide member 4, as seen in FIG. 6. The disc portion 20 is formed with a convexed shape raised toward the center thereof, and is provided with a plurality of projections as seen in FIG. 19. The effect of the projections 23 will be explained later. A pair of shaping rollers 24,25 are placed about the center of the disc portion 20. Frame 28 extends from bearing sleeve 27 of the shaft 26 of the disc 7. Accordingly, the frame 28 extends from the bearing sleeve 27 to the center portion of the forward surface of the disc portion. The forward end of the frame 28 surrounds the contacting roller 22 so as to support the engaging disc 7 and to journal the shaping rollers 24,25. Accordingly, the shaping rollers 24,25 rotate in response to the rotation of the disc 7, but do not provide active motion in themselves. The back surface of the disc portion 20 is formed with beveled teeth 29 which engage with the bevel gear 31 rotatably mounted on the supporting rod 30 secured to the bearing sleeve 27. The sprocket wheel 32 is secured to the bevel gear 31. The sprocket wheel 32 is connected to the sprocket wheel 33 mounted on the shaft 16 of the worm 15 through the chain 34, and the rotation of the drive motor 8 is transmitted to the disc 7. The contacting roller 22 forms an outer circumferential surface having a plurality of cavities 35 which increase the frictional resistance when contacted with the inner surface of the end portion 3 of the duct 2. This results in firm smooth movement of the bending apparatus 1. The engaging roller 6 and the pressing disc 7 are connected to each other by the adjustment mechanism 10 which provides a suitable space relationship between roller 6 and disc 7. More specifically, the forward end of the connecting frame 36, which extends from the supporting frame 12 of the engaging roller 6, is riveted on an end of an elongated bolt 38. Bolt 38 extends through projection 37 provided on the base end of the bearing sleeve 27 of the disc 7. The elongated bolt 38 has the other end 39 threaded into a cap nut 40. A helically wound spring 41 is intervened between the cap nut 40 and the projection 37, and applies a biased force toward nut 40 and projection 37 in opposite directions. The cap nut 40 has an inner bottom portion provided with a spacer 42 inserted therein (shown in FIG. 5A and FIG. 5B), which serves as an auxiliary adjustment means. The spacer 42 may be replaced in accordance with the varying thickness of the reinforced guide member 4 or the lip 3, enabling micro-adjustment. Also, the cap nut 40 is provided with a handle 43 for rotating. The handle 43 can be folded as shown in FIG. 5A, and has a spring 44 inserted into the hinge portion to be folded and a lock mechanism to hold the handle in a folded condition.

Figure 7:
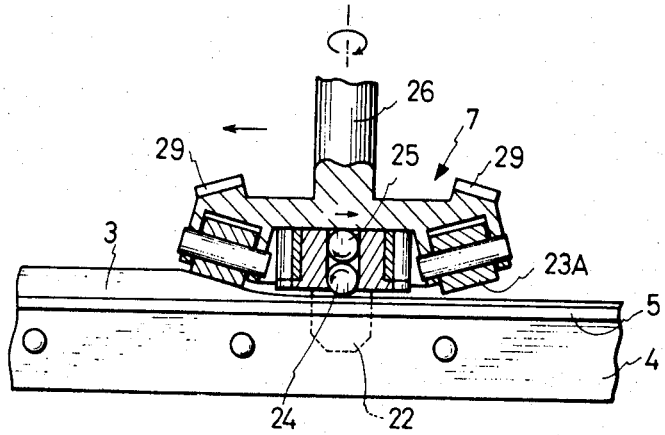
FIG. 7 is a partially enlarged cross-sectional view showing the bending operation of a pressing disc.

The following is a description of the operation of the bending apparatus of the present invention, which is comprised as described above:

The starting point of the end portion 3 of the duct 2 is suitably bent by a hammer or the like. The disc 7 contacts and applies pressure to the end portion 3. The engaging roller 6 is engaged with the upright portion 5 of the guide member 4, as shown in FIGS. 5 and 6. The handle 43 of the adjustment means 10 is unlocked, extended and rotated in order to put the disc 7 and the engaging roller 6 in a suitably spaced relationship. Accordingly, the bending apparatus is mounted on the end portion 3 to be bent. Subsequently, the motor 8 is energized in order to rotate the engaging roller 6 in contact with the upright portion 5. The disc 7 on the opposite side of the engaging roller is rotated in synchronism with the engaging roller 6. Thus, the end portion 3 of the duct 2 is sequentially bent as shown in FIG. 1 and in FIG. 7. As the forward surface of the disc 7 is raised toward the center, the end portion 3 is introduced from the outer periphery toward the center portion of the surface and, therefore, the bending operation is effected without difficulty. Also, projections 23 on the disc portion 20 increase the smoothness of the operation.

The disc 7 and the engaging roller 6 are supported and guided by the upright portion 5 of the guide member 4 holding the end portion 3 under pressure in order to sequentially bend the end portion. Further, the rotation of the disc 7 and the engaging roller 6 moves the whole apparatus forward with the aid of the contacting roller 22. The contacting roller 22 is formed with cavities 35 for protecting against slipping by increasing the frictional resistance between the inner side surface of the end of the duct 2 and the roller 22.

Figure 8:
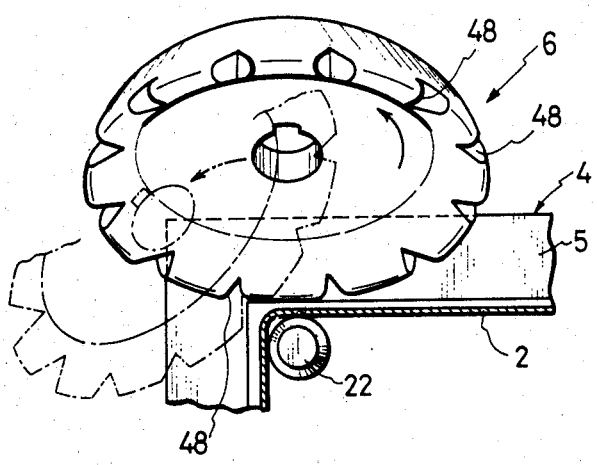
FIG. 8 is a partially enlarged view showing the operation of an engaging roller.

When the bending apparatus 1 comes to a corner portion of the duct 2 (shown in FIG. 1 by the apparatus 1 as drawn by one long and two short-dashed lines), the apparatus 1 turns along the corner of the duct without loosening or slipping, because the engaging roller 6 has an outer periphery formed with a plurality of V-shaped cavities 48 at predetermined intervals for engaging the corner, as shown in FIG. 8. Furthermore, the bending apparatus 1 moves up and down without being inclined due to the effect of the auxiliary rollers as shown in FIG. 9.

In this manner, the bending apparatus 1 moves along the lip 3 of the duct 2, completing the bending operation upon a revolution.

In addition, the bending apparatus 1 is provided with an automatic stopping means which includes a touch piece 53 extending toward the advancing direction of the apparatus 1 so as to be adjacent to the end portion 3 to be bent. The touch piece 53 is connected to switch means 54 (such as a limit switch), and is adapted to be "on" or "off", depending upon the movement of the touch piece 53. The switching means 54 is connected to the motor 8 and turns the motor "on" and "off" upon the on-and-off motion of the switching means, as shown in FIG. 1. Accordingly, when the bending apparatus 1 approaches an interruptive material 55 ahead of it, the touch piece 53 contacts the material 55, which turns off the switching means 54, automatically stopping the bending apparatus 1. The switching means has a contacting point which is normally closed. Furthermore, the stopping means may be used for another purpose. For example, when the operator wants to stop the work, he may stop the operation by intentionally putting a hammer or any other tool in front of the apparatus 1.

The stopping means may serve as an automatic stopping means after the completion of the operation, if the touch piece 53 is placed at another suitable position. More specifically, the touch piece 53 may be provided with a roller, for normally touching the end portion 3 under suitable pressure. The switching means 54 will be "off" when the bending apparatus completes the bending operation, since the end portion 3 is bent in an upwards direction, thus automatically stopping the bending apparatus.

Figure 12:
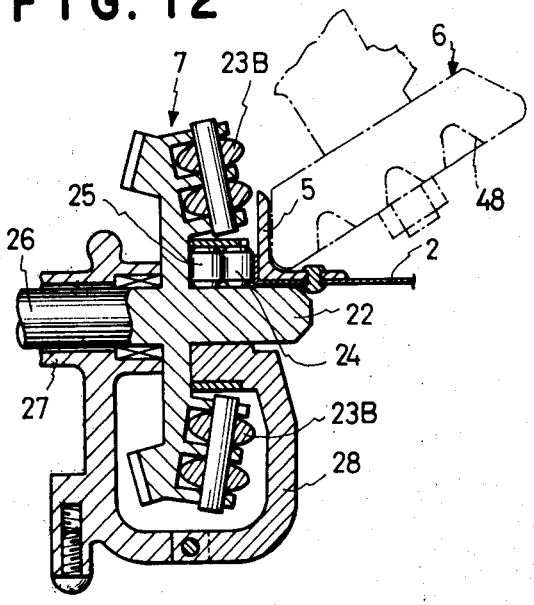
Figure 13:
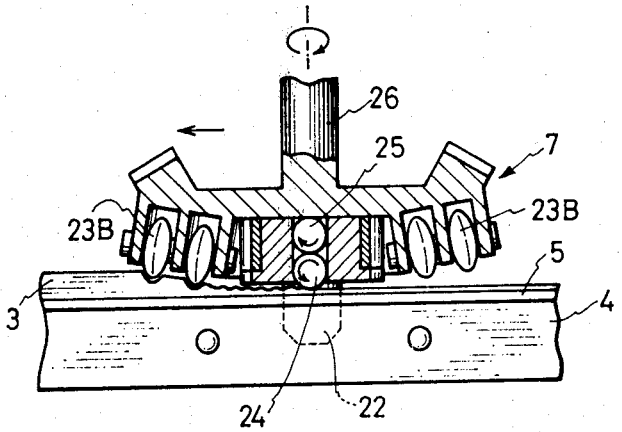
Figure 14:
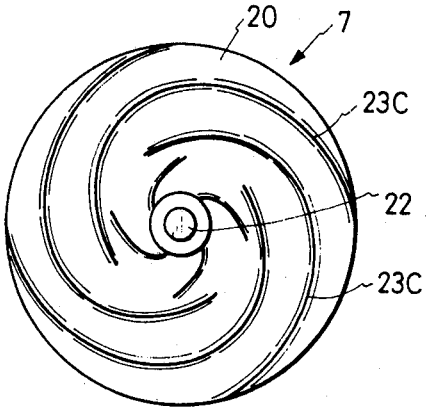
Figure 15:
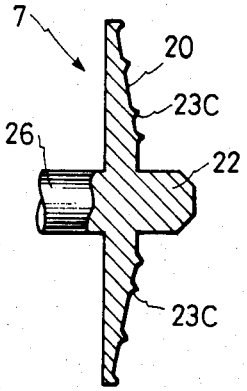
Figure 16:
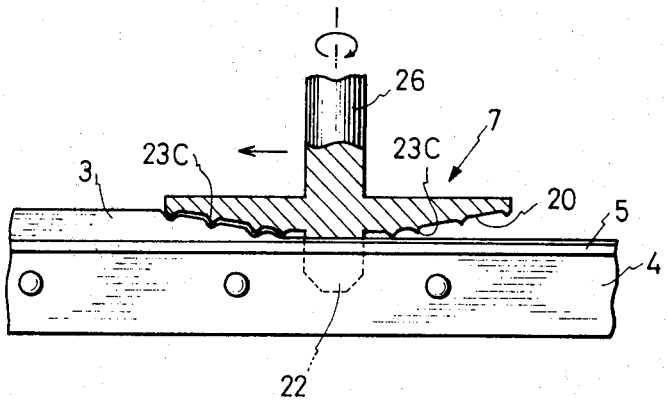
Figure 17:
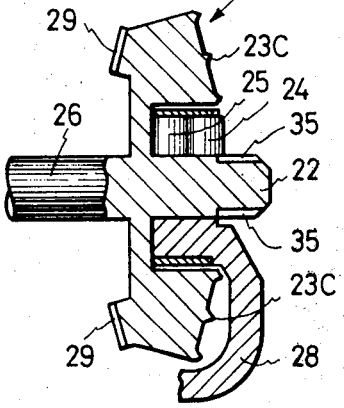
Figure 18:
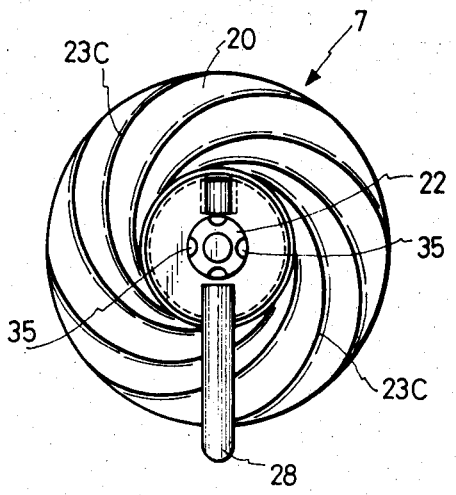

The embodiments of the projections 23 on the disc 7 are shown in FIG. 10–FIG. 19. In FIG. 10, the projections 32 are rotatable rollers 23A, which are radially formed on the disc 7. The projections in FIGS. 11–13 are the rollers 23B of elliptical cross-section, which contact generally at points with the end portion 3, in order to decrease the friction therebetween. Both rollers 23A and rollers 23B aid in making the bending smooth, and cause no damage to the end portion 3. The projections 23 in FIGS. 14–16 are formed in spiral forms centripetal of the disc portion 20, as shown in the numeral 23 C, thereby introducing the end portion 3 smoothly into the bending process and completing the bending effectively. The projections in FIGS. 14–16 are shown in FIGS. 17–19 with shaping rollers 24,25.

The projections may be tuberculated projections arranged on a centripetal line, or rotatable balls arranged in the same manner.

Figure 20:
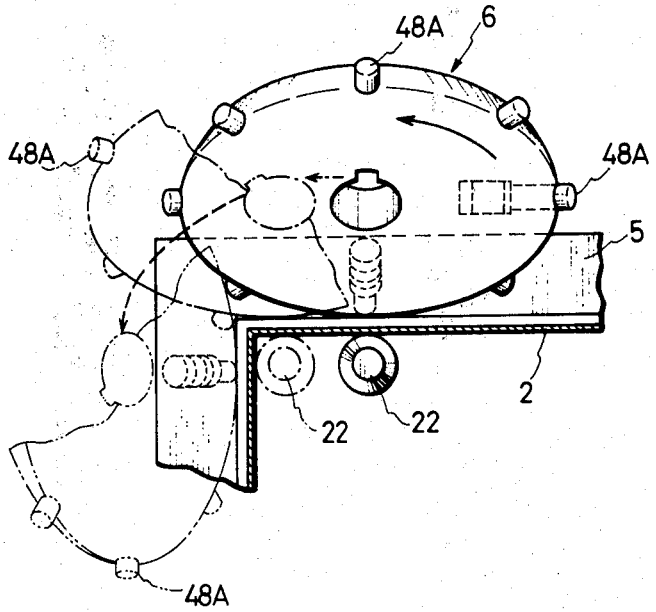
FIG. 20 is a partially enlarged view showing an embodiment of an engaging roller.

FIGS. 20 and 21 show another embodiment of the engaging roller 6 wherein engaging projections 48A are shown in a radial pattern in place of V-shaped cavities 48 on the circumferential surface. The engaging projections 48A are normally applied by an extending force by means of a spring 45. The projections 48A are retractable according to the rotation of the engaging roller 6.

Figure 23:
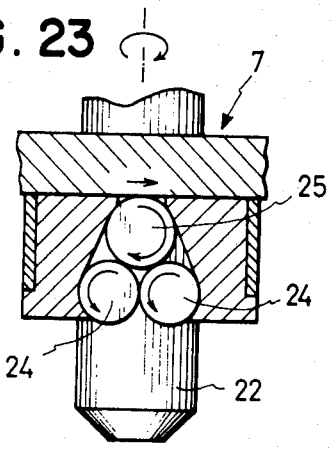

In FIGS. 22 and 23, the shaping rollers 24,25 consist of three or four rollers. The two rollers 24 are arranged to directly contact with the lip 3 to be bent. Thereby, a more accurate bending operation may be achieved.

Figure 24:
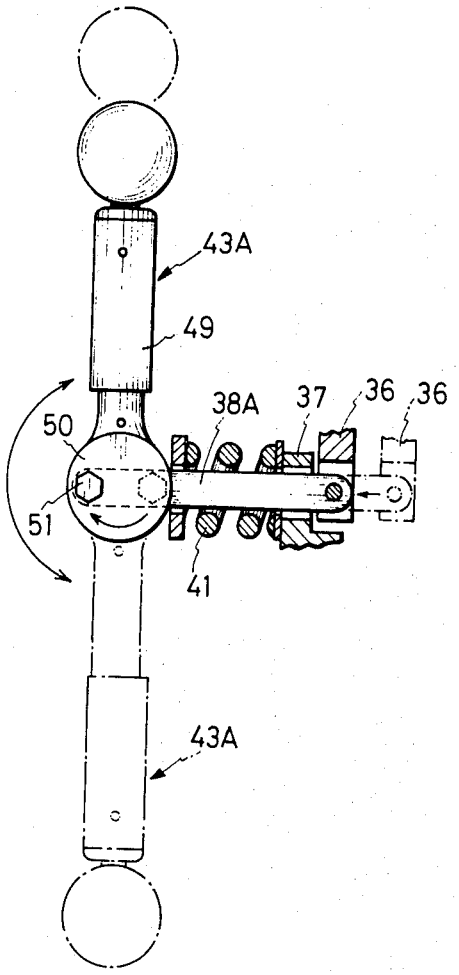
FIGS. 24 and 25 are partially enlarged views showing embodiments of a handle.
Figure 25:
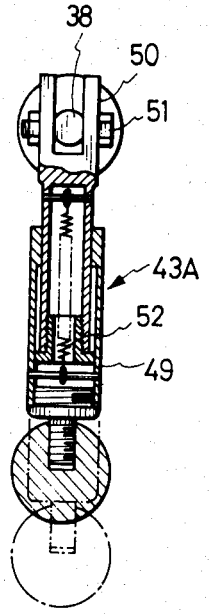

In FIGS. 24 and 25, another embodiment of a handle of the adjustment mechanism 10 is illustrated. The handle 43A is retractable by the effect of the spring 52 included within the handle shaft. In addition, the journaled portion 50 of the handled shaft 49 is eccentrically arranged with respect to the connecting shaft 51 of the shaft 38A. Shaft 38A corresponds to bolt 38. The handle is adapted to be moved upward and downward so as to adjust the position of the disc 7 during advancing movement.

The invention herein set forth has been shown and described in what is believed to be the most practical and preferred embodiments. It is recognized, however, that departures may be made therefrom which are within the scope of the invention, and that obvious modifications will occur to one skilled in the art.

What is claimed:

1. An apparatus for bending an end portion of a metal plate, said plate being reinforced with a guide member generally L-shaped in cross-section, said guide being secured to said plate adjacent said end portion comprising:

a frame member;

an engaging roller having a broad outer edge, said roller being rotatably mounted on said frame;

a pressing disc rotatably mounted on said frame, said disc having an outwardly facing surface positioned opposite said outer edge;

a plurality of rollers rotatably positioned on said outwardly facing surface of said disc;

means for adjusting the distance between said outer edge of said roller and said outwardly facing surface of said disc; and a drive motor mounted on said frame, said motor being connected to said engaging roller and said disc, and being capable of rotating said roller and disc, said roller and disc being arranged such that said end portion of said metal plate may be bent as said disc forceably presses said end portion against said L-shaped guide member, and said edge of said roller opposes said pressing force.

2. An apparatus as in claim 1 wherein said engaging roller has a generally trapezoid-shaped cross-section.

3. An apparatus as in claim 1 wherein said broad outer edge of said engaging roller has a plurality of U-shaped cavities thereon.

4. An apparatus as in claim 1 further comprising a plurality of engaging projections radially extending outward from said edge of said engaging roller, said projections being biased radially outward and being retractable.

5. An apparatus as in claim 1 further comprising:

a pair of auxiliary rollers positioned on opposite sides of said engaging roller, said auxiliary rollers being rotatably mounted.

6. An apparatus as in claim 1 wherein:

said pressing disc has a generally T-shaped cross-section with a shaft member forming the stem of the "T" and the disc forming the cross of the "T", said shaft protruding outwardly beyond said outwardly facing surface, said surface having a plurality of roller members positioned thereon adjacent one another and forming a rotatable contacting roller portion on said surface of said disc.

7. An apparatus as in claim 6 wherein said roller members are cylindrically shaped.

8. An apparatus as in claim 6 wherein said roller members are spherically shaped.

9. An apparatus as in any of claims 6, 7 and 8 wherein said roller members have rough surfaces.

10. An apparatus as in claim 6 wherein said adjusting means is comprised of:

an elongated bolt connected to said frame, said bolt being positioned parallel to said shaft of said disc;

a connecting protection provided on said frame, said protection at least partially surrounding said bolt;

a cap nut threaded onto said bolt;

a spring applying a biasing force between said cap nut and said connecting projection; and a handle mounted on said cap nut.

11. An apparatus as in claim 10 wherein said handle is capable of being folded.

12. An apparatus as in claim 11 wherein said handle includes a lock mechanism for retaining the folded condition.

13. An apparatus as in claim 11 wherein said adjusting means includes an auxiliary adjustment means which comprises a spacer having a thickness or a width corresponding to the thickness of a metal plate to be bent, said spacer provided in the inner bottom portion of said cap nut.

14. An apparatus as in claim 1 further including an automatic stopping means comprising a touch-sensitive piece mounted on said frame; and a switch means in connection with said motor for stopping said motor in response to an object touching said touch-piece.

15. An apparatus for bending an end portion of a metal plate, said plate being reinforced with a guide member generally L-shaped in cross-section, said guide being secured to said plate adjacent said end portion comprising:

a frame member;

an engaging roller having a broad outer edge, said roller being rotatably mounted on said frame;

a pressing disc rotatably mounted on said frame, said disc having an outwardly facing surface positioned opposite said outer edge, and wherein said surface forms a centripedal spiral pattern;

means for adjusting the distance between said outer edge of said engaging roller and said outwardly facing surface of said pressing disc; and a drive motor mounted on said frame, said motor being connected to said engaging roller and said disc, and being capable of rotating said roller and disc, said roller and disc being arranged such that said end portion of said metal plate may be bent as said disc forceably presses said end portion against said L-shaped guide member, and said edge of said roller opposes said pressing force.

* * * * *